US005353933A

United States Patent [19]

Takahashi et al.

[11] Patent Number: 5,353,933

[45] Date of Patent: Oct. 11, 1994

[54] PACKAGE OF ROLLED PHOTOSENSITIVE MATERIAL

[75] Inventors: Hisashi Takahashi; Shigehisa Shimizu; Satoshi Mino; Hiroyuki Osanai; Koji Kudo, all of Kanagawa, Japan

[73] Assignee: Fuji Photo Film Co., Ltd., Minami-Ashigara, Japan

[21] Appl. No.: 91,031

[22] Filed: Jul. 14, 1993

[30] Foreign Application Priority Data

Jul. 15, 1992 [JP] Japan ..... 4-049601[U]

[51] Int. Cl.[5] ..... B65D 85/67

[52] U.S. Cl. ..... 206/398; 206/410; 206/413

[58] Field of Search ..... 206/398, 397, 403, 407, 206/408, 410, 413, 414, 415, 416, 455, 389

[56] References Cited

U.S. PATENT DOCUMENTS

| | | | |
|---|---|---|---|
| 4,452,846 | 6/1984 | Akao . | |
| 4,579,781 | 4/1986 | Akao . | |
| 4,661,395 | 4/1987 | Akao . | |
| 4,733,777 | 3/1988 | Van Geyte et al. | 206/416 X |
| 4,911,299 | 3/1990 | Peeters . | |
| 5,049,928 | 9/1991 | Tirone | 206/414 X |
| 5,133,171 | 7/1992 | Chase et al. | 206/414 X |
| 5,222,601 | 6/1993 | Takahashi et al. . | |

FOREIGN PATENT DOCUMENTS

| | | |
|---|---|---|
| 414265 | 2/1991 | European Pat. Off. . |
| 436133 | 7/1991 | European Pat. Off. . |

*Primary Examiner*—Jacob Sewell
*Assistant Examiner*—Jacob Ackun
*Attorney, Agent, or Firm*—Burns, Doane, Swecker & Mathis

[57] ABSTRACT

A package of rolled photosensitive mateiral comprising a core, a photosensitive strip material wound around the core, a light-shielding leader connected to the end of the photosensitive strip material to shield the peripheral surface of the photosensitive strip material from light and side light-shielding covers connected to both sides of the light-shielding leader so that the boundary between the side light-shielding covers and the light-shielding leader corresponds to the boundary between the peripheral surface and the side surface of the photosensitive strip material. The core is formed by laminating at least 2 sheets of a base paper being moistureproof. The side light-shielding covers are composed of a composite film having a polyethylene film having light-shielding ability and a uniaxially oriented film or a biaxially oriented film made of polyester, polyethylene polypropylene or nylon with the length of the side light-shielding covers being not less than twice as long as the outer periphery of a roll of the photosensitive strip material.

9 Claims, 3 Drawing Sheets

PACKAGE OF ROLLED PHOTOSENSITIVE MATERIAL

BACKGROUND OF THE INVENTION

The invention relates to a package of a rolled photosensitive material usable for loading in a light room.

A package of a rolled photosensitive material usable for loading in a light room is loaded into a magazine in light-shielding state, and the light-shielding ability of the package is broken in the magazine, and a photosensitive strip material is extended through the slit of the magazine.

The above mentioned conventional package of a rolled photosensitive material comprises a core, a photosensitive strip material wound around the core, a light-shielding leader connected to the leading end of the photosensitive strip material to shield the peripheral surface of the photosensitive strip material from light and side light-shielding covers connected to both sides of the light-shielding leader so that the boundary between the side light-shielding covers and the light-shielding leader corresponds to the boundary between the peripheral surface and the side surface of the photosensitive strip material to shield the side surface of the photosensitive strip material from light, and at least one of the above mentioned light-shielding leader and side light-shielding covers are composed of the material which tends to tear along the direction of the boundary (EP 0 414 265 A2 which corresponds to Japanese Utility Model KOKAI No. 3-77933). The above mentioned conventional package is preferable because it can be made easily and at low cost.

However, since the light-shielding leader and the side light-shielding cover were made of only polyethylene film they had disavantages, such as the occurrence of pinholes and the loss of light-shielding ability caused by the external force through drop and vibration which occur during transportation. Particularly, the side light-shielding covers have these disadvantages.

Besides, since the core is made of a conventional paper holder, it is insufficient in moistureproofness upon to temperature and moisture changes during transportation or storage. Thus, moisture can permeate into the package, and affect adversely the photographic properties of the photosensitive strip material. On the other hand, although a cushioning package for preventing the occurrence of pinholes and a moistureproof package for preventing the permeation of moisture may be utilized they are expensive because of a special package.

SUMMARY OF THE INVENTION

An object of the invention is to solve the above mentioned problems and to provide a package of a rolled photosensitive material wherein pinholes do not occur and moisture does not permeate into the package.

The invention has been made in order to achieve the above mentioned object and the core and the side light-shielding covers are made of special materials.

That is, a package of a rolled photosensitive material of the invention comprises a core, a photosensitive strip material wound around the core, a light-shielding leader connected to the leading end of the photosensitive strip material to shield the peripheral surface of the photosensitive strip material from light and side light-shielding covers connected to both sides of the light-shielding leader so that the boundary between the side light-shielding covers and the light-shielding leader corresponds to the boundary between the peripheral surface and the side surface of the photosensitive strip material, said core is formed by laminating at least 2 sheets of a base paper having moistureproofness, said side light-shielding covers are composed of a composite film composed of a polyethylene film having light-shielding ability and a uniaxially oriented film or a biaxially oriented film made of polyester, polyethylene, polypropylene or nylon and the length of the side light-shielding covers is not less than twice as long as the outer periphery of a roll of the photosensitive strip material.

Figure 1:
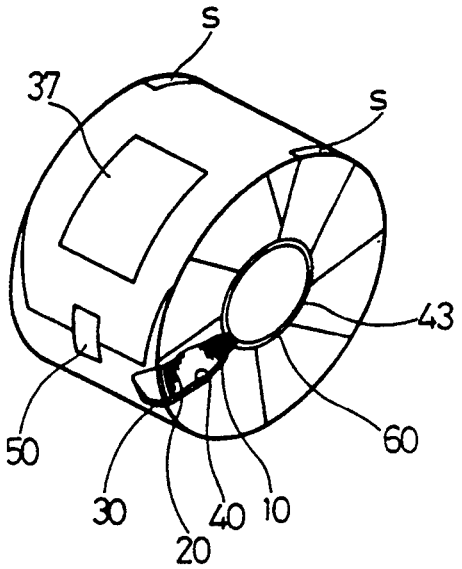
FIG. 1 is a partly broken away perspective view of a package of a rolled photosensitive material of the present invention.
Figure 2:
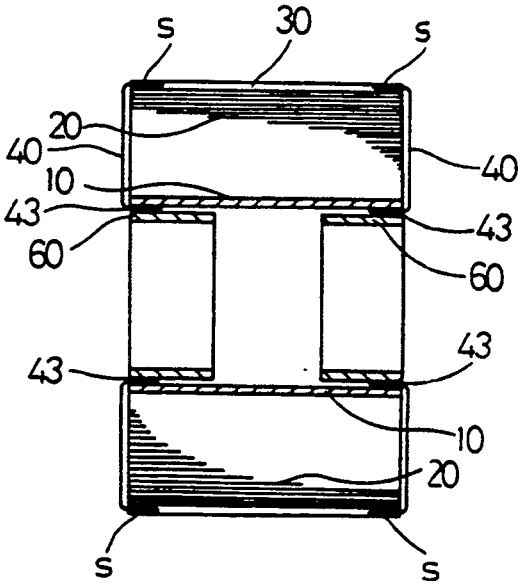
FIG. 2 is a partly broken away sectional view of a package of a rolled photosensitive material of the present invention.
Figure 3:
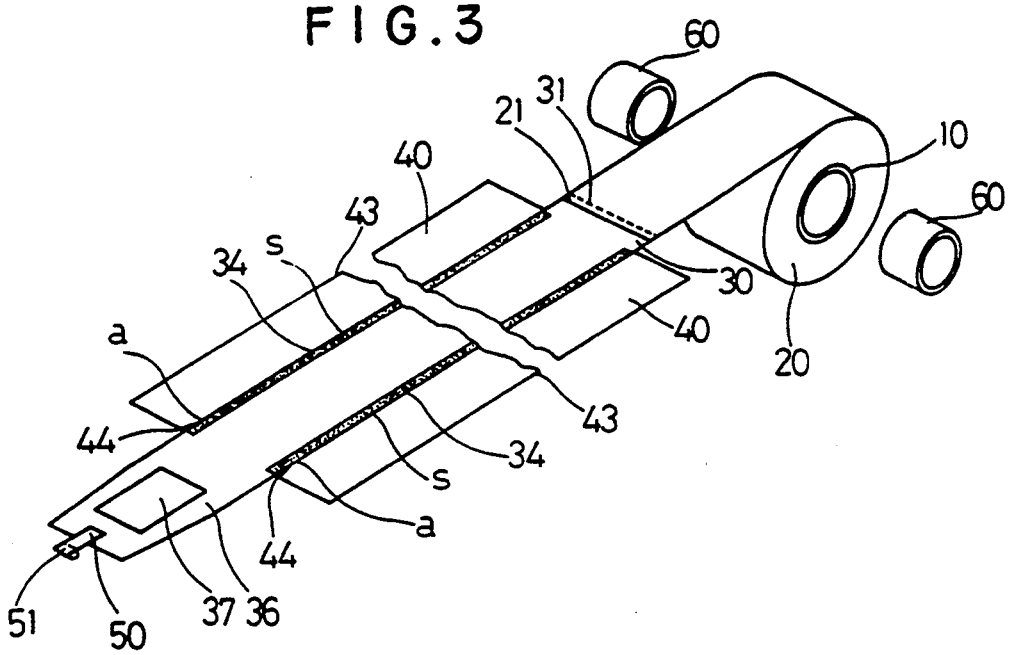
FIG. 3 is a exploded perspective view of a package of a rolled photosensitive material of the present invention.
Figure 4:
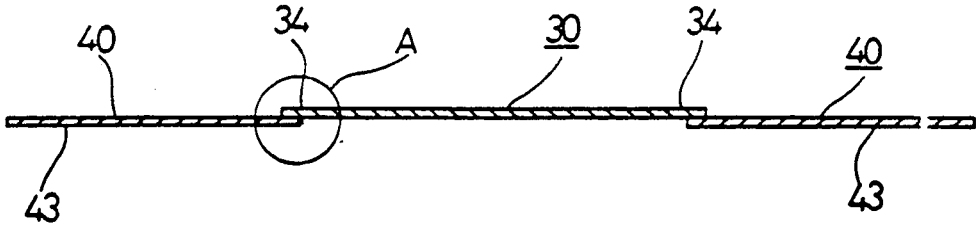
FIG. 4 is a sectional view of a light-shielding leader part and a side light-shielding cover part of a package of a rolled photosensitive material of the present invention.

10 . . . Core
11 . . . Base paper
20 . . . Photographic paper (photographic strip material)
30 . . . Light-shielding leader
40 . . . Side light-shielding cover
41 . . . Polyester film
42 . . . Polyethylene film
50 . . . End tape
60 . . . Bushing
a . . . Outer boundary of adhesion part
s . . . Adhesion part

DETAILED DESCRIPTION OF THE INVENTION

The core is formed by laminating at least 2 sheets of a base paper having moistureproofness. The base paper is not particularly limited so far as it does not adversely affect a photosensitive material to be wound. For example, as a pulp used for the base paper for paper core, chemical pulp such as SP and KP, semichemical pulp, such as CTMP and CGP, and mechanical pulp are usable, and waste paper of newspaper and waste paper of carbon are also usable. Preferable base papers for paper core are small generation of sulfur compound, formalin, etc. (for example, neutral paper described in Japanese Patent KOKAI No. 3-180583). These base papers may be used alone or in a combination thereof.

The base paper for paper core is preferably 0.2–1.0 mm in thickness and 150–750 g/m$^2$ in areal weight. In order to prevent staining of the surface and peeling off at the cut end, decorative paper is preferably wound around the outermost layer. A preferable thickness of the decorative paper is 0.05–0.2 mm.

In order to make the base paper moistureproof, a resin is coated on a surface of the base paper, a moistureproof film or a metallic foil is laminated onto the base paper, or the like. The coating resin includes polyethylene, polypropylene, etc., and the moistureproof film includes polyethylene film, polyvinylidene chloride film, metallized film, a silicated film, etc., and the metallic foil includes aluminum foil, iron foil, copper foil, etc.

The water vapor permeability of the base paper having moistureproofness is preferably 1–20 g/m$^2$·24 hr particularly 1–10 g/m$^2$·24 hr, per one sheet according to JIS Z 0208 (40° C., 90% RH).

Besides, the core is composed of at least 2 sheets of the base paper. When the core is composed of only one base paper, it is difficult to ensure moistureproofness because moisture permeates the space between the base paper coiled in spiral.

The side light-shielding covers are formed of a composite film composed of a uniaxially oriented film or a biaxially oriented film, made of polyester, nylon, polyethylene or polypropylene, and polyethylene film having light-shielding ability. By using the composite film, drop strength and abrasion resistance as well as heat sealing ability and tear strength are improved.

Examples of the uniaxially oriented film or the biaxially oriented film made of polyester, nylon, polyethylene or polyplopylene include;

| | |
|---|---|
| polyester: | |
| Lumilar | (Toray Ind. Inc.) |
| Espet film | (Toyobo Co., Ltd.) |
| Enblet | (Unitika Ltd.) |
| nylon: | |
| Harden film | (Toyobo Co., Ltd.) |
| Emblem | (Unitika Ltd.) |
| polyethylene: | |
| Hybron film | (Mitsui Toatsu Chemical Inc.) |
| Variela film | (Nisseki Plasto Co., Ltd.) |
| polypropylene: | |
| Taiko Fo | (Nimura Sansho) |
| Silphan | (Gunze Sangyo Inc.) |
| Pilen film-ST | (Toyobo Co., Ltd.) |

An example of the polyethylene film having light-shielding ability is polyethylene film containing more than 0.1 wt. % of carbon black disclosed in Japanese Patent KOKOKU Nos. 2-2700, 2-2701.

The side light-shielding cover may be composed of the composite film and the other film laminated thereonto. For example, a polyethylene film having light-shielding ability is laminated onto a biaxially oriented polyester film, and another polyethylene film having light-shielding ability is laminated onto the oriented polyester film side of the laminated film.

The length of the side light-shielding cover is not less than twice as long as the outer periphery of a photosensitive strip material, preferably from 2.1 times to 2.3 times that of the outer periphery. When the length is less than twice that of the above outer periphery, light-shielding ability and moistureproofness are insufficient due to the presence of only a single layer forming at least a part of the side cover. For this reason, the impact strength is also insufficient for transportation.

The light-shielding leader requires rigidity in some degree in order to advance the side light-shielding covers along the outside adhesion boundary in addition to light-shielding ability, moistureproofness and heat sealing ability. The rigidity required here is suitably selected according to the material and the thickness of the side light-shielding cover. However, the rigidity of the adhered side light-shielding cover is added to the above mentioned rigidity, and accordingly, the rigidity is not necessary to tear the side light-shielding covers by itself but is sufficient if it has more than the rigidity of side light-shielding covers.

As the materials of the light-shielding leader, a polyethylene film having light-shielding ability, a polyester film having light-shielding ability, composite films composed of a uniaxially oriented film or a biaxially oriented film made of polyester, nylon, polyethylene or polypropylene and a polyethylene film having light-shielding ability laminated thereonto are usable.

The light-shielding leader is longer than the side light-shielding covers and is used as the leader for extending the light-shielding leader out of the magazine, when the end of the light-shielding leader is loaded in the magazine. Besides, in order to facilitate joining the base end of the light-shielding leader with the photosensitive strip material in mechanical viewpoint, the light-shielding leader preferably is provided with margins at the forward end and the base end of the side light-shielding covers.

Adhesion between the light-shielding leader and the side light-shielding cover is conducted by a method using ultrasonic, a heating bar, an impulse sealer, a heat roller, adhesive, an adhesion tape, or the like.

When the outer boundary of the adhesion part is located at the side surface of the roll of the photosensitive strip material, not shearing force but tension acts during extending the light-shielding leader. Accordingly, resistance against tearing the side light-shielding cover increases. For this reason, the distance between the outer boundaries of both adhesion parts is preferably slightly narrower than the width of the photosensitive strip material in view of dimensional error, such as winding discrepancy occurring when the side light-shielding cover and the light-shielding leader are wound around the photosensitive strip material, and location slip occurring when the light-shielding leader is joined to the photosensitive strip material. However, if dimensional error does not occur at manufacturing, the outer boundaries of the adhesion parts are preferably almost corresponding to the outer peripheral edges of the photosensitive strip material. Besides, both edges of the light-shielding leader preferably have non-adhered parts, because the outer boundaries of the adhesion parts are used for an accelerating line for tearing.

The adhesion between the light-shielding leader and the photosensitive strip material preferably has a sufficient strength not to be peeled off, when the package is loaded into an apparatus. Moreover, when the light-shielding leader is extended, the adhesion has a peel strength capable of separating easily and completely between the end of the photosensitive strip material and the base end of the light-shielding leader. As the adhesion method, for example, there are some methods using ultrasonic, a heating bar, an impulse sealer, a heat roller, adhesive, an adhesion tape or the like.

As the photosensitive strip material applicable to the package of a rolled photosensitive material of the invention, there are a photographic paper, a photographic film, etc. Photosensitive strip materials having 150–300 mm in outer diameter and 76–600 mm in width are preferable in view of its dimension.

In the package of a rolled photosensitive material of the invention, the photosensitive strip material is packaged in a light-shielding state by the light-shielding leader and the side light-shielding covers, and at the time of extending the photosensitive strip material, the side light-shielding covers are torn along the adhesive boundary between the light-shielding leader and the side light-shielding cover. Pinholes do not occur on the side light-shielding cover, and moisture does not permeate through the core.

Figure 6:
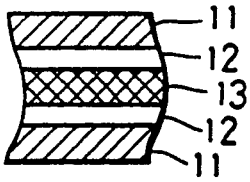
FIG. 6 is a partly sectional view illustrating a layer construction of a core of a package of a rolled photosensitive material of the present invention.

In FIGS. 1 to 4, the numeral 10 indicates a core having moistureproofness. As shown in FIG. 6, the base paper having moistureproofness used in the core 10 is composed of a base paper 11 for paper core, an ethylene resin layer 12 for adhesion, a biaxially oriented HDPE (high density polyethylene) film (Tonen Sekiyu Kagaku) 13 having 20 μm in thickness, an ethylene resin layer 12 for adhesion and a base paper 11 for paper core from the inside (the lower side in the figure).

The core 10 is composed of the innermost two layers of the base paper having moistureproofness, eight layers of the base paper for paper core laminated on the base paper layers and one uppermost layer of a decorative paper laminated on the base paper for paper core layer, and is 76.2 mm in inside diameter, 86 mm in outside diameter and 117 mm in width. The moistureproofness is 9 $g/m^2 \cdot 24$ hr under an atmosphere at 40° C. at 90% RH.

A photographic paper 20 as the photographic strip material is wound around the core 10 in a roll. The photographic paper 20 is formed of polyethylene laminated paper as the base material having 0.23 mm in thickness, 117 mm in width and 180 m in length, and the outside diameter is 245 mm. An end 31 of the light-shielding leader 30 is adhered to the back side of the end 21 of the photographic paper 20 in a peel-free state by ultrasonic adhesion having 10 mm of a superimposed part.

Figure 5:
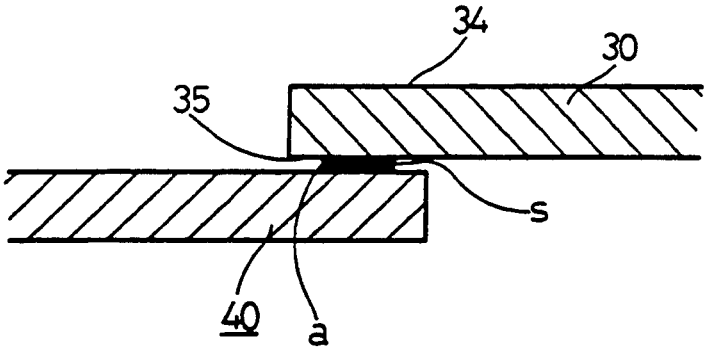
FIG. 5 is a enlarged view of a A part in FIG. 4.
Figure 7:
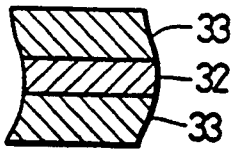
FIG. 7 is a partly sectional view illustrating a layer construction of a light-shielding leader of a rolled photosensitive material of the present invention.

The size of the light-shielding leader 30 is 1900 mm in total length, 123 mm in width and 110 μm in thickness, as shown in FIG. 7. The light-shielding leader 30 is a composite film composed of a polyester film 32 having 25 μm in thickness, polyethylene film 33,33 laminated on both sides of the above polyester film 32 having 53 wt. % of linear polyethylene, 43 wt. % of high density polyethylene and 4 wt. % of carbon black, and having 40 μm in thickness. As shown in FIG. 5, the side light-shielding covers 40 are adhered at the back side of both edges 34,34 of the light-shielding leader 30 by adhesion part S having 5 mm in width, and not adhered parts 35,35 are left in 3 mm in width in a state that edges of the light-shielding covers 40,40 are superimposed in 10 mm. Besides, margins almost 50 mm from the end and 250 mm from the base end of the light-shielding leader 30 are not superimposed by the side light-shielding cover 40 and the end of the light-shielding leader is the leader part 36 which is to be a tip used for extending a photographic paper 20 out of a magazine. Moreover at the leader part 36, a label 37 to display product informations is attached at the position 30 mm apart from the end. The label 37 has a size of 80 mm in width and 50 mm in length, and is printed with paper surfaces, length, width, lot number, expiration date, etc. of the photographic paper and indication symbols symbolizing this informations.

Figure 8:
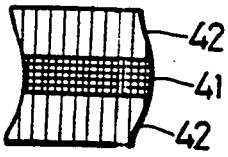
FIG. 8 is a partly sectional view illustrating a layer construction of a side light-shielding cover of a rolled photosensitive material of the present invention.

The side light-shielding covers 40 has a size of 1600 mm in total length, 120 mm in width, 100 μm in thickness, and as shown in FIG. 8, is a composite film composed of a polyester film 41 having a thickness of 16 μm, polyethylene films 42,42 having a thickness of 40 μm containing 53 wt. % of linear low density polyethylene, 43 wt. % of high density polyethylene and 4 wt % of carbon black laminated onto both sides of the polyester film 41. A notch 44 having a length of 5 mm is formed in order to ensure and facilitate opening at the forward end of the side light-shielding cover 40 at a distance of 2 mm toward the out side from the outer boundary of the adhesion part S.

The light-shielding leader 30 is wound twice around photographic paper 20, and the leader part 36 of the end of the light-shielding leader is adhered to itself by an end tape 50. The end tape 50 is provided with a pick-up part 51 having a length of 10 mm on which adhesive is not coated in order not to injure the photographic paper 20 through the light-shielding leader 30 by finger nail or the like, during peeling of the end tape 50 (the handling part may be formed by folding an edge of the tape). Besides, the side light-shielding cover 40 is folded along the side surface of the rolled photographic paper 20, and the side edge 43 thereof is inserted into the core 10 and fixed by the insertion of a bushing 60 into the core 10 with pressure.

The bushing 60 is made of paper, and is 74.4 mm in outside diameter, 69 mm in inside diameter and 40 mm in width. When the outside diameter of the bushing 60 is d, the thickness of the side light-shielding cover 40 is t, the length of the side light-shielding cover 40 is 1 and the inside diameter of the core 10 is D, it is preferable to satisfy a $$\text{relation of } 0.6 \leqq t \times 1/(\pi/4 \times (D^2 - d^2)) \leqq 0.9$$

$$\text{particularly } 0.7 \leqq t \times 1/(\pi/4 \times (D^2 - d^2)) \leqq 0.8$$

Figure 9:
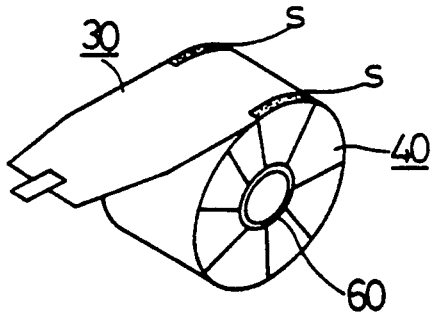
FIG. 9 is a perspective view illustrating a state of extending a photosensitive strip material in a package of a rolled photosensitive material of the present invention.

A movement of extending the photographic paper from the package loaded in a magazine is explained. First, when the package is loaded in a magazine (not illustrated), as shown in FIG. 9, the tip of the light-shielding leader 13 is extended and projects from the slit of the magazine.

When the light-shielding leader 30 is drawn in this state, force f pulling to the center acts on the notch 44 of the side light-shielding cover 40 in addition to a shearing force. As a result, the notch 44 is going to proceed in a diagonally inward direction b, but since the inner part from the notch 44 is connected to the light-shielding leader 30 an increase in strength results. Accordingly, the inward proceeding of the notch 44 is inhibited and consequently, the side light-shielding covers 40 are torn along adhesion outside boundaries. The adhesion part S of the light-shielding leader 30 and the side light-shielding covers 40 are extended out from the slit opening, and a not-adhered part of the side light-shielding covers 40 remain on the sides of the photographic paper 20.

Figure 10:
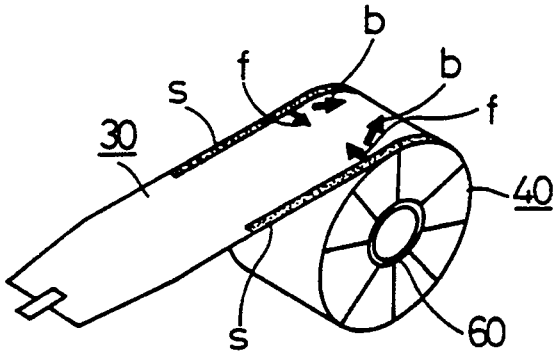
FIG. 10 is a perspective view illustrating a state of extending a photosensitive strip material in a package of a rolled photosensitive material of the present invention.
Figure 11:
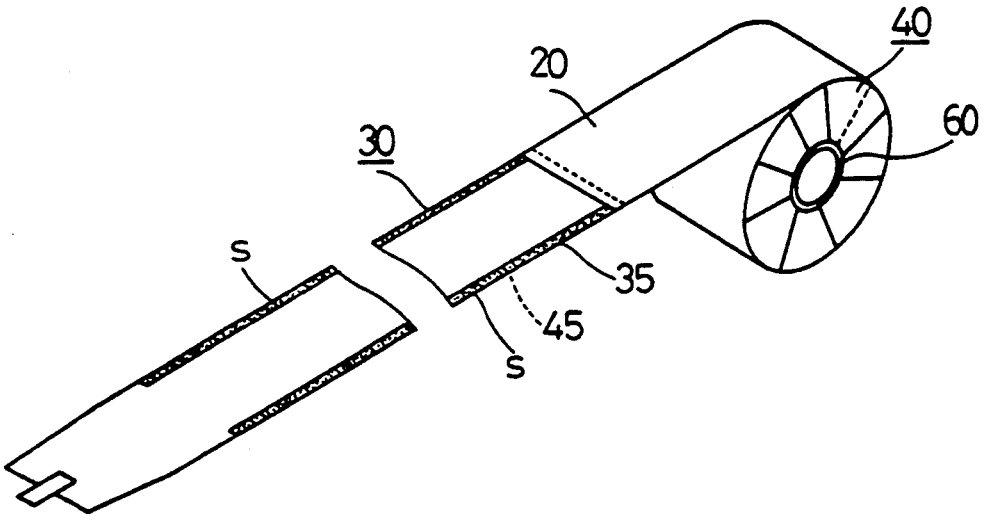
FIG. 11 is a perspective view illustrating a state of extending a photosensitive strip material in a package of a rolled photosensitive material of the present invention.

Moreover, when the light-shielding leader 30 is completely extended from the slit opening, as shown in FIG. 10, the light-shielding leader 30 is completely separated from the side light-shielding covers 40, and resistance to rotating the photographic paper 20 is removed.

What is claimed is:

1. A package of a rolled photosensitive material comprising a core, a photosensitive strip material having an end and wound around the core to provide a peripheral surface, a light-shielding leader connected to the end of the photosensitive material to shield the peripheral surface of the photosensitive material from light and side light-shielding covers connected to both sides of the light-shielding leader so that the boundary between the side light-shielding covers and the light-shielding leader corresponds to the boundary between the peripheral surface and the side surface of the photosensitive strip material, said core being formed by laminating at least 2 sheets of a moistureproof base paper.

2. The package described in claim 1 wherein said base paper is formed of a member selected from the group consisting of chemical pulp, semichemical pulp and mechanical pulp.

3. The package described in claim 1 wherein said base paper is 0.2 to 1.0 mm in thickness.

4. The package described in claim 1 wherein said base paper is 150–750 $g/m^2$ in areal weight.

5. The package described in claim 1 wherein said base paper has a water vapor permeability of 1–20 $g/m^2 \cdot 24$ hr per one sheet.

6. The package described in claim 1 wherein the outside diameter of a bushing d, the thickness of the side light-shielding cover t, the length of the side light-shielding cover 1 and the inside diameter of the core D satisfy a relation of $0.6 \leqq t \times 1/(\pi/4*(D^2-d^2)) \leqq 0.9$.

7. A package of a rolled photosensitive material comprising a core, a photosensitive strip material having an end and wound around the core to provide a peripheral surface, a light-shielding leader connected to the end of the photosensitive material to shield the peripheral surface of the photosensitive material from light and side light-shielding covers connected to both sides of the light-shielding leader so that the boundary between the side light-shielding covers and the light-shielding leader corresponds to the boundary between the peripheral surface and the side surface of the photosensitive strip material, said side light-shielding covers being composed of two polyethylene films having light-shielding ability laminated onto a biaxially oriented polyester film from both sides of the biaxially oriented polyester film.

8. The package described in claim 7 wherein the length of the side light-shielding covers is not less than twice as long as the peripheral surface of the photosensitive strip material.

9. The package described in claim 7 wherein the end of the light-shielding leader is adhered to the end of the photosensitive material by ultrasonic adhesion.

* * * * *